US005334247A

United States Patent [19]

Columbus et al.

[11] Patent Number: 5,334,247

[45] Date of Patent: Aug. 2, 1994

[54] COATER DESIGN FOR LOW FLOWRATE COATING APPLICATIONS

[75] Inventors: Richard L. Columbus, Rochester; Harvey J. Palmer, Lima, both of N.Y.

[73] Assignee: Eastman Kodak Company, Rochester, N.Y.

[21] Appl. No.: 735,577

[22] Filed: Jul. 25, 1991

[51] Int. Cl.[5] ..... B05L 3/18

[52] U.S. Cl. ..... 118/411; 118/410; 118/412; 118/415; 239/553.3; 239/590.3

[58] Field of Search ..... 118/411, 412, 415, 410; 239/553.3, 566, 590, 590.3, 597; 430/435; 427/438; 222/342, 488

[56] References Cited

U.S. PATENT DOCUMENTS

| | | | |
|---|---|---|---|
| 2,065,298 | 12/1936 | Abbott | 118/415 |
| 2,414,874 | 1/1947 | Herbst | 239/553.3 |
| 2,525,055 | 10/1950 | Ward, Jr. | 239/566 |
| 3,019,178 | 1/1962 | Williams | 239/590.3 |
| 3,020,579 | 2/1962 | O'Connor | 239/566 |
| 3,032,008 | 5/1962 | Land et al. | 118/411 |
| 3,996,025 | 12/1976 | Gulden | 239/553.3 |
| 4,220,114 | 2/1980 | Radowicz | 118/411 |
| 4,246,335 | 1/1981 | Keogh et al. | 118/415 |
| 4,347,805 | 9/1982 | Ernest . | |
| 4,440,811 | 4/1984 | Hitaka et al. . | |
| 4,466,574 | 8/1984 | Dobson et al. | 239/590.3 |
| 4,687,137 | 8/1987 | Boger et al. . | |
| 4,708,629 | 11/1987 | Kasamatsu | 118/411 |
| 4,774,109 | 9/1988 | Hadzimihalis et al. . | |
| 5,010,840 | 4/1991 | Busker | 118/410 |

FOREIGN PATENT DOCUMENTS

| | | | |
|---|---|---|---|
| 663837 | 5/1963 | Canada . | |
| 2756133 | 7/1978 | Fed. Rep. of Germany | 118/410 |

*Primary Examiner*—W. Gary Jones
*Assistant Examiner*—Todd Burns
*Attorney, Agent, or Firm*—Dana M. Schmidt

[57] ABSTRACT

There are disclosed coaters that repeatedly and intermittently apply a uniform, thin coating of liquid onto a support at a rate that does not exceed the maximum swell rate of the support. Thus, developer liquid can be applied to photographic paper supports without leaving behind liquid effluent.

The coater features a delivery channel leading from a manifold chamber to a slit orifice, the channel being improved in that it contains a plurality of spaced-apart wall portions connecting the opposed flow surfaces of the delivery channel, that extend in a direction towards the slit orifice, and structure inside the orifice for coalescing the individual streams fed by these wall portions, into a continuous strip of liquid to be dispensed by the slit orifice.

7 Claims, 6 Drawing Sheets

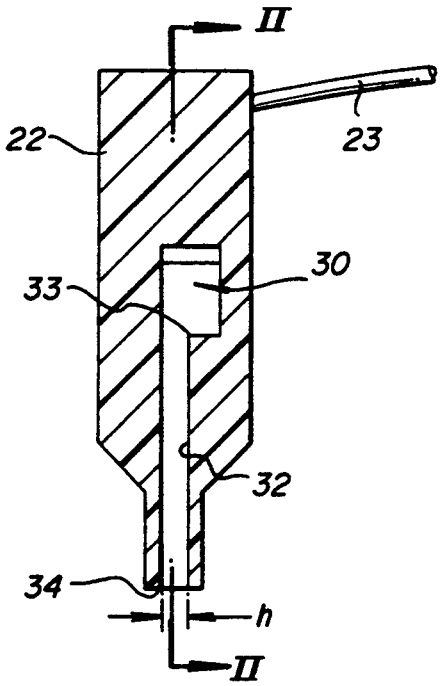
FIG. 1
PRIOR ART
FIG. 2
PRIOR ART
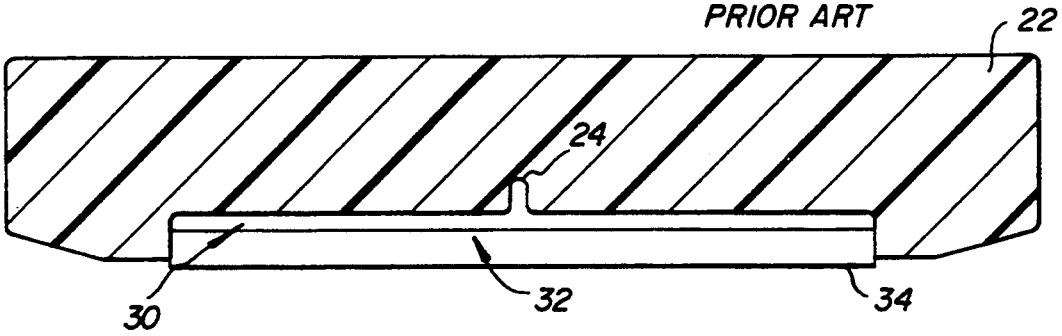
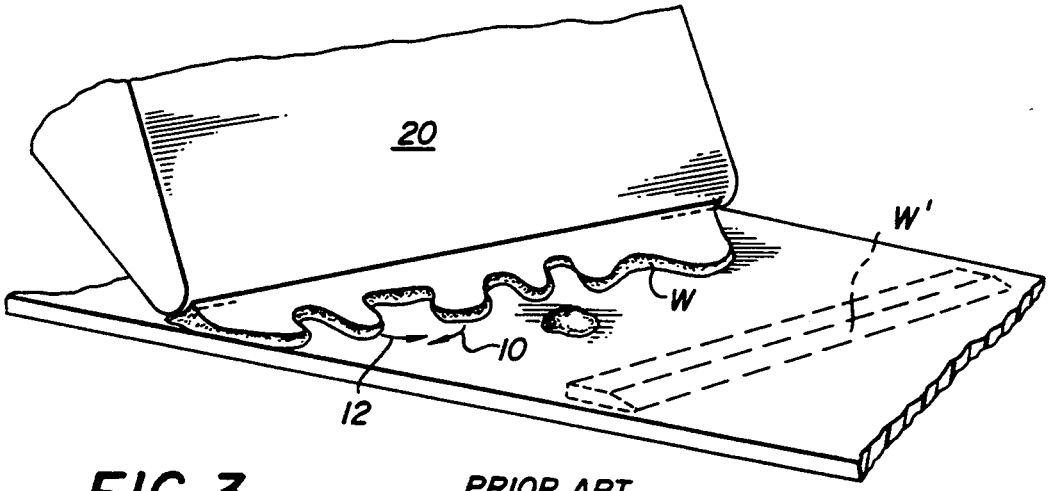
FIG. 3 PRIOR ART

COATER DESIGN FOR LOW FLOWRATE COATING APPLICATIONS

FIELD OF THE INVENTION

This invention is directed to a coater for applying liquid uniformly and intermittently, at a slow rate which, in the case of photographic products being coated, does not exceed the swell rate of the products.

BACKGROUND OF THE INVENTION

A key concern of the '90's is how to preserve the environment. Preservation efforts include the elimination or detoxification of effluents, including waste water from photographic processors. Conventionally, large baths are used by such processors, which contain chemicals of various toxic types to develop photographic images. Such excess aqueous solutions have only two options for disposal—either they have to be constantly reused (to avoid disposal entirely), or they have to be disposed of in a way that is not harmful to the environment. The former solution has the disadvantages of requiring constant adjustments to the chemical concentrations to deal with depletion of desired chemicals and the possible buildup of, or contamination from, undesired chemicals. For example, the use of baths of excess developer solution means that if subsequent stations are used for a treatment of continuous streams of photographic product, each at a different concentration, there is a risk of cross-contamination as the product moves from one station to another. The alternative of dumping a contaminated bath in favor of a fresh batch has the disadvantages of requiring removal of the noxious chemicals, if possible, prior to dumping, or contamination of the environment, if not possible.

Such disadvantages could be obviated entirely if excess developer solutions could be avoided. Although such an approach suggests as a solution, using only the amount of developer solution needed to swell and develop a given print, and no more, it has not been possible to apply such an amount of effluent-free developer to photographic material using conventional coaters. As used herein, "effluent-free" means free of liquid effluent, since the swelling of the gelatin has to be reduced by removing the water in a heater as vapor. However, such a gaseous effluent is less harmful than liquid effluents. That is, conventional coaters typically apply a continuous stream that exceeds in volume and rate that which the underlying support can absorb, so that there are fewer demands on the coater. However, if the liquid to be coated is delivered only at the volume and at a rate that can be absorbed for development purposes, the coater has to be able to stop and start intermittently, and at the same time produce a liquid wavefront that is controlled and of uniform width, depth, and length. Such a coating operation has not been possible using coaters of the prior art. Furthermore, to be commercially viable, the coater must be able to be mass produced, preferably of injection molded plastic, and require minimum operator attention to function properly. This means that the effectiveness of the coater must not depend on machining tolerances that are unrealized by traditional techniques for fabricating injection molded parts (tolerances of less than 0.005").

Finally, it has been suggested in the past that a liquid effluent-free process of development is possible if one sprays developer onto the photographic product. See, e.g., Canadian Patent 663,837. The problem with spraying is that a fine mist, high pressure spray produces a saturating mist of caustic pH that is itself intolerable. A low pressure, coarse mist spray avoids this problem, but fails to produce a coating that is sufficiently uniform.

Hence, prior to this invention it has not been possible to provide a method of effluent-free developing of a photographic product using only the volume and rate of liquid that can be absorbed by that product during development, e.g., from about 5.0 to about 100 $mL/m^2$ over about 30 sec., since no coater was available that had this capability. (As noted above, "effluent-free" as used in this application refers to freedom from significant liquid effluent, that is from amounts of liquid effluent that have to be disposed of in ways that risk contamination of the environment. Any coater that inadvertently leaves a few drops of developer behind is not considered to produce "significant" liquid effluent.)

SUMMARY OF THE INVENTION

We have developed a coater that makes possible an effluent-free development of photographic products, as defined above.

More specifically, in accordance with one aspect of the invention, there is provided a coater for delivery of liquid in a uniform layer onto a surface, the coater comprising a body having an internal manifold chamber of a width generally equal to the width of a photographic product, means for introducing the liquid at a point within the chamber, and a delivery channel having a length extending from the manifold to an orifice shaped to deliver the uniform layer of liquid. The coater is improved in that the delivery channel comprises spaced-apart, opposed surfaces connected together for the majority of the delivery channel length at spaced intervals by a plurality of wall portions extending between the surfaces in a direction toward the orifice to confine liquid flow into spaced-apart individual streams of flow between the wall portions, and coalescing means inside the orifice and downstream of said wall portions for coalescing the individual streams together into a substantially continuous strip of liquid while still inside the orifice.

Accordingly, it is an advantageous feature of the invention that a developing process is provided using a coater that produces no significant liquid effluent that has to be reused or disposed of.

It is a related advantageous feature of the invention that the coater provided for this purpose is readily manufacturable on a repeated basis.

Another advantageous feature of the invention is that baths of developer solutions need not be monitored and/or modified after use since the amount of solution used has only a single use, once dispensed.

Another related advantageous feature of the invention is the prevention of cross-contamination of various developer solutions, since they remain either in closed containers (the coater) or are quickly absorbed into their assigned photographic product.

Other advantageous features will become readily apparent upon reference to the following detailed description of the preferred embodiments, when read in light of the attached drawings.

BRIEF DESCRIPTION OF THE DRAWINGS

FIG. 1 is a transverse sectional view of a coater of the prior art;

FIG. 2 is a section view taken generally along the line II—II of FIG. 1 of the prior art.

FIG. 3 is a perspective view of a coating operation of a comparative example, e.g., of the prior art;

DESCRIPTION OF THE PREFERRED EMBODIMENTS

The invention is hereinafter described in connection with the preferred embodiments, in which the coater is described for development of preferred photographic paper using certain preferred, developer solutions. In addition, the coater can be used to apply any kind of liquid to any kind of surface whether or not the surface is absorptive or part of a photographic product.

As used herein, "developer liquid" means any solution effective to develop a latent photographic image in the surface onto which the solution is applied. Most preferably, the developer solution is free of known surfactants. Instead, surfactants, if needed at all, are preferably found in the surface being coated.

Figure 4:
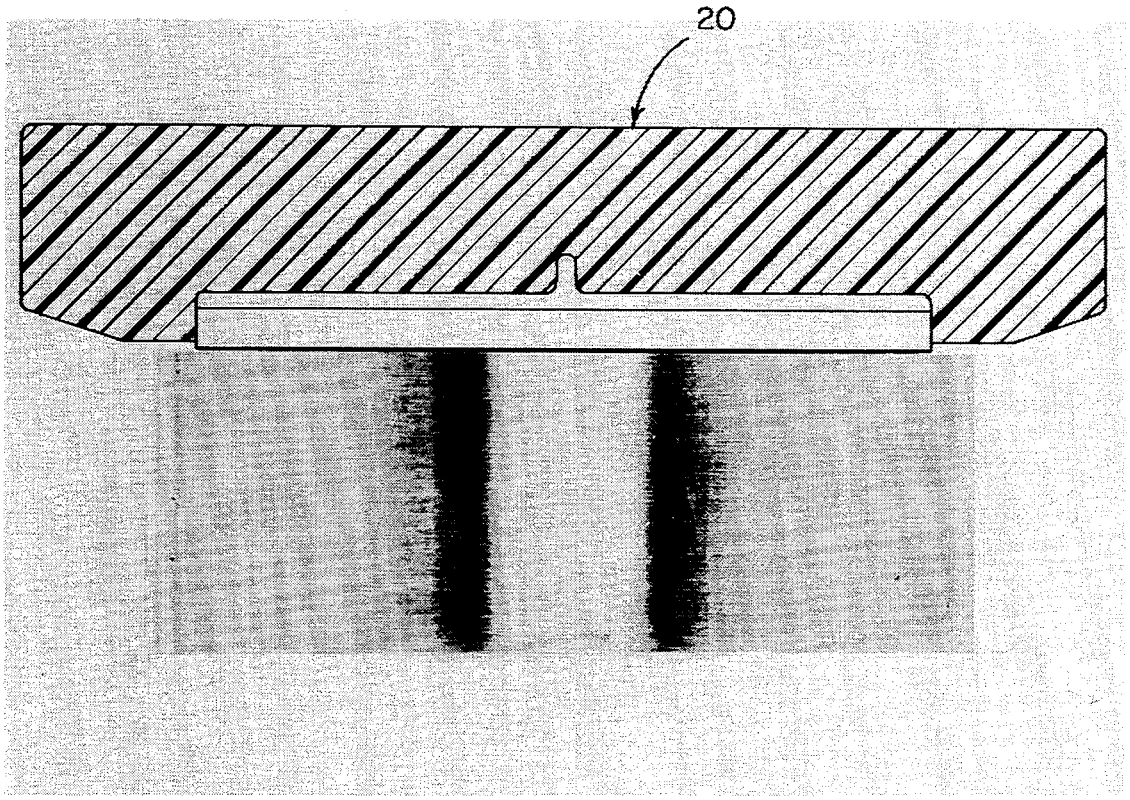
FIG. 4 is a schematic view of both a sectional coater and the resultant print produced therefrom, as a comparative example.

Regarding the photographic product that is the surface to which the developer solution is applied, that product, as noted, needs to be absorptive at the rate the developer solution is applied. This usually requires a layer of gelatin, or its equivalent, which will absorb the liquid and swell during development. Most preferably, to preclude the wavefront of liquid from breaking into discontinuous puddles on contact with the product due to high surface tension, the product also, in addition to being absorptive, is sufficiently wettable to uniformly attract the wavefront, thus preventing wavefront break-up. (Such break-up is illustrated in FIG. 3, a comparative example. The illustrated break-up of wavefront W produces fingers that run together, arrows 10,12, to create entrapped air pockets that are insufficiently treated. Instead, what is desired is a uniformly continuous wavefront W', shown in phantom, out of the orifice of coater 20. Otherwise, characteristically the product develops in streaks, as shown in FIG. 4, also a comparative example.)

Figure 5:
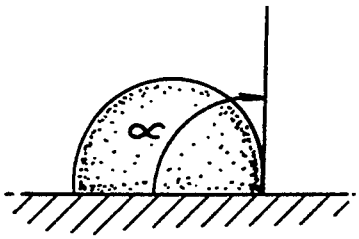
FIG. 5 is a schematic view illustrating the contact angle measurements made as described hereinafter.

A convenient and preferred measure of this wettability is the contact angle the developer solution makes with the photographic product. We have determined that, to maintain the proper wavefront (W' as shown in FIG. 3), that contact angle should be less than about 45° when measured by standard goniometer techniques 400 sec after applying liquid. FIG. 5 is an illustration of the contact angle in question.

A wide variety of photographic products provides such contact angles. For example, those that bear on their surface an unhardened layer of gelatin, such as conventional x-ray film or paper commonly have a contact angle of about 28° (e.g., for "Min-R" TM x-ray paper available from Eastman Kodak Co.) and hence are useful.

PRIOR ART COATER

Referring now to FIGS. 1 and 2, the coater of this invention has in common certain features with the prior art. Both of them comprise a body 22 into which is fed the solution to be coated, via a supply line 23, FIG. 1, from a closed storage vessel. To introduce the liquid into the coater at a point, the supply line exits at an aperture 24, FIG. 2. This aperture in turn feeds directly to an internal manifold chamber 30 having a width generally equal to the width of the desired wavefront. Beyond the manifold chamber and fluidly fed therefrom is a delivery channel 32 that leads from a junction surface 33 with chamber 30, to a slit orifice 34 on an exterior edge of the coater, that deposits the liquid wavefront onto the support or photographic product. As is more clearly shown in FIG. 1, channel 32 is much narrower in height h than the manifold for the entire width of the channel, with height "h" being generally on the order of 0.05 mm±1%, thus producing a very high pressure drop across the channel 32. This pressure drop is needed to spread the point source of the liquid throughout chamber 30 before it exits through channel 32.

There are several problems with such a coater. One is that such a narrow channel tends to produce local discontinuities, as shown in FIG. 3, at the wavefront. This is particularly true when applying developer solutions to photographic products at a rate (0.02–0.05 $ml/m^2/sec$) that is no more than the product can absorb. That is, such a coating rate is much slower than the rate the conventional coater uses. These slower rates induce the wavefront to break up more than occurs at the faster, conventional rates. The reasons include local variations in at least the absorptivity of the support at the wavefront, and in the wettability of the support. Also higher coating rates assure that a substantial excess of liquid is delivered to the surface to accommodate any variability in absorptivity. It is the elimination of such excesses that is the motivation behind the current invention. Still further, the high precision for height "h" precludes making the coater out of inexpensive materials.

THE INVENTION

Figure 6:
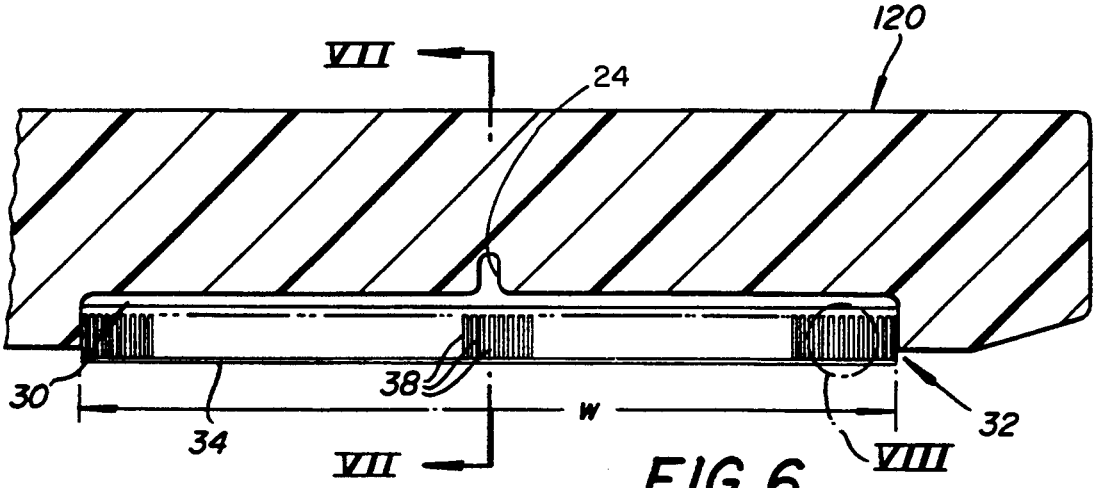
FIG. 6 is a section view similar to that of FIG. 2, but illustrating a coater constructed in accord with the invention.
Figure 7:
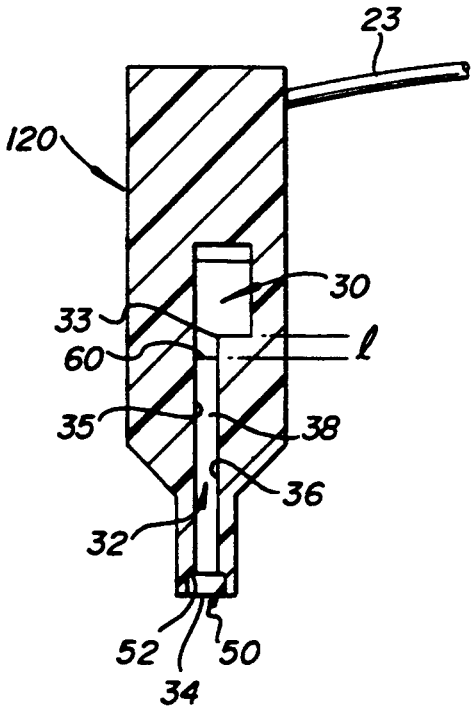
FIG. 7 is a section view taken generally along the line VII—VII of FIG. 6.

In accordance with the invention, and as a solution to the foregoing, we have found, FIGS. 6 and 7, that the same coater 120 is drastically improved by constructing channel 32 so that the spaced-apart, opposing surfaces 35 and 36, FIG. 7, defining the major flow contact within channel 32, are connected together for the majority of the channel length, at spaced intervals, by wall portions 38. By "majority", it is meant that at least 50% of the length of channel 32, as shown for example in FIG. 7 from its inception at edge 33 to the orifice 34, is occupied by the wall portions. Wall portions 38 preferably extend substantially completely across the space between surfaces 35 and 36, and can be spaced along the width "w", FIG. 6, at regular or irregular intervals, provided there are enough of them. Substantially complete extension between surfaces 35 and 36 is preferred, since otherwise the wall portions tend not to be effective to break up the flow into individual streams. Preferably they extend in a direction from chamber 30 to orifice 34, and most preferably in a direction that is perpendicular to the edge of coater 120 defining orifice 34.

Figure 8:
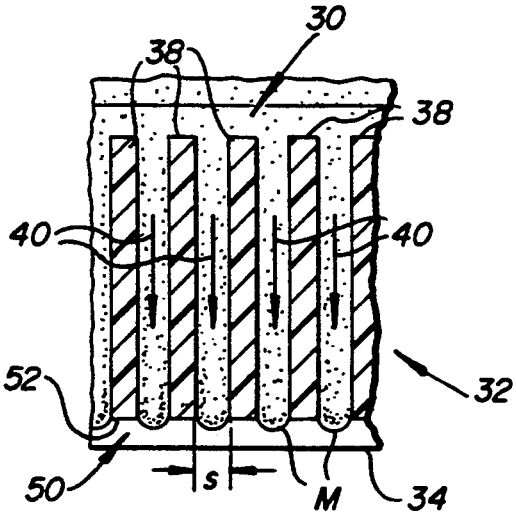
FIG. 8 is an enlarged, fragmentary section view similar to, but of the portion of, FIG. 6 that is marked as "VIII", showing the coater with liquid in the quiescent mode.

The function of wall portions 38 is to divide up the liquid flow into discrete, individual streams 40, as is more clearly shown in FIG. 8. Most preferably such streams, and therefore the wall portions 38, are generally parallel. The reason for the success of the discrete streams is not completely understood. However, the following is one possible explanation: Without the break-up of the liquid into individual streams by the wall portions, the advancing meniscus is free to advance unevenly towards the orifice, so that upon exiting, a non-linear, uneven wavefront is deposited. However, the wall portions in contrast break up the liquid into the individual streams that do not form a continuous wavefront again until IMMEDIATELY at the orifice. The length of the coalescing means that provides this reformation is discussed below.

Figure 9:
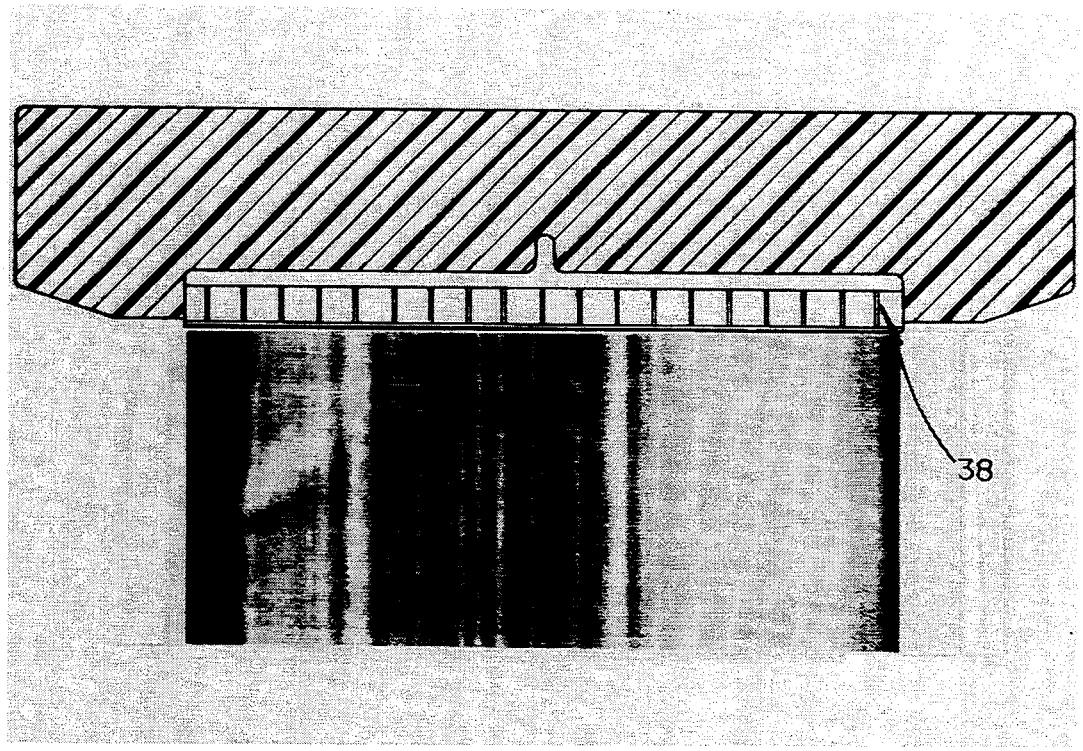
FIG. 9 is a section view similar to that of FIG. 4, illustrating yet another comparative example.

Regarding the number of occurrences of wall portions 38, along the width "w", it will be apparent that, as the number decreases, one eventually reaches a condition little different from that of FIG. 4 where there are NONE. The minimum number needed varies, depending on the nature of the liquid being coated. However, for a developer solution used with photographic products, preferably that number is such that the spacing "s", FIG. 8, between most of them is less than 5 mm. The reason is illustrated in FIG. 9 which shows a comparative example where wall portions 38 were about 5.0 mm apart, at regular intervals, and the developed print was considered to be just barely unacceptable due to the variations in the density produced. Thus, preferred examples of a useful spacing include, e.g., one in which the walls are between about 0.4 and about 0.8 mm apart, across the width "w", FIG. 6. (In all the examples showing a developed print, i.e. in FIGS. 4, 9 and 13, the concentration of developer was watered down by about 50%, to more clearly denote flow irregularities.

It will be readily appreciated that walls 38 can be too close together, at which point they form pores that are so small compared to the impermeable wall space that the performance is unacceptable. For developer solutions, spacing less than about 0.1 mm is considered too close together to be particularly useful for a uniform spacing. If the spacing is irregular, a few can be this close if most are spaced at about 0.4 to 0.5 mm.

To allow for maximum air displacement when liquid first enters chamber 30, it is preferred that connecting walls 38 not extend back through delivery channel 32 to the junction surface 33, FIG. 7. Instead, walls 38 start at a position 60 away from surface 33, towards slit orifice 34. The spacing distance "l" between position 60 and junction surface 33 can be from about 0.1 mm to about 1.0 mm, with about 0.3 mm preferred. Such spacing provides an open, continuous flow chamber, in contrast to the case if walls 38 were to lengthwise extend all the way from junction surface 33.

Figure 10:
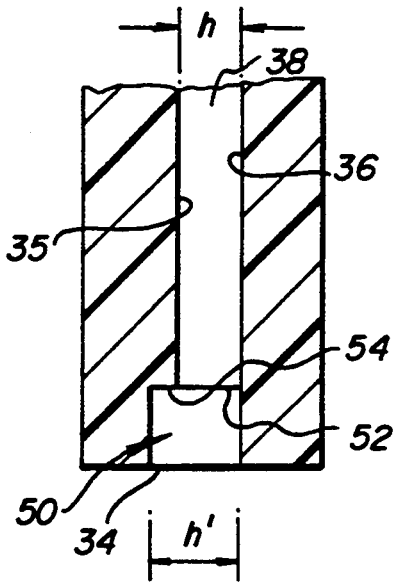
FIG. 10 is a fragmentary section view similar to that of FIG. 7, but of an alternate embodiment.

To create the coalescing pocket 50, FIGS. 7 and 8, for coalescing the individual streams 40 (FIG. 8) into a substantially continuous strip or bead of liquid just inside orifice 34, when the liquid is ejected, wall portions 38 do not extend all the way to orifice 34. Instead, they stop short at edges 52. When liquid is no longer to be coated, the previously-coated liquid breaks off at edges 52, leaving, FIG. 8, individual menisci M, FIG. 8, of the individual streams 40. Such behavior is important, because without coalescing pocket 50, the coater while quiescent will produce a meniscus that traverses the entire width of channel 32. When that happens, air intrusion occurs due to the large surface area exposed, and the long meniscus starts to fall out in puddles, leaving unacceptable quantities of liquid at the work station, possibly on the next product to be exposed. This in turn produces uneven amounts, and possibly excessive amounts, of developer on the next product. In addition, the air that has intruded into the hopper forms pockets that obstruct liquid flow during the next coating cycle, producing grossly non-uniform fluid delivery which cannot be compensated for, by the coalescing means at the orifice. Preferably, to further induce the menisci M, FIG. 8, to stop at edge 52, pocket 50 is constructed so that spaced-apart surfaces 35 and 36, FIGS. 7 and 10, are stepped abruptly farther apart in pocket 50 than they are in channel 32. This creates at least one edge surface 54 in surface 35 or 36 as shown in FIG. 10, to induce menisci M, FIG. 8, to stop at edge surface 52. Most preferably, FIG. 7, there are two such edge surfaces 52.

For example, whereas spacing "h", FIG. 10, can be about 0.4 mm, the spacing h' of surfaces 35 and 36 at pocket 50 is about 0.5 mm.

The length of pocket 50, measured in the direction extending from edge 54 to orifice 34, is preferably no greater than about 2.5 mm, so as to avoid the problem noted above of a non-uniformly located meniscus that is created by the prior art orifice that lacks the wall portions completely.

The substantially continuous strip of liquid that must be produced by the coalescing means, refers to a strip that is sufficiently continuous as to not produce noticeable streaking upon development.

Figure 11:
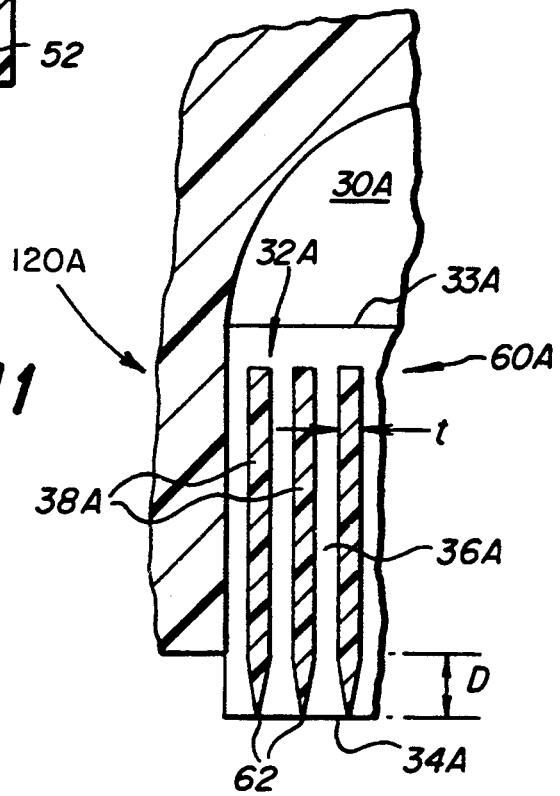
FIG. 11 is a fragmentary section view similar to that of FIG. 8, but of yet another alternate embodiment.

Alternatively, the connecting wall portions can lengthwise extend all the way to the slit orifice and still create a coalescing pocket, if those wall portions are feathered in width at the slit orifice, FIG. 11. Parts similar to those previously described bear the same reference numeral to which the distinguishing suffix "A" is appended.

Thus, coater 120A features the same manifold chamber 30A, delivery channel 32A and slit orifice 34A as before, with connecting wall portions 38A connecting the opposed flow surfaces (of which only surface 36A is shown). As before, wall portions 38A commence at position 60A spaced away from junction surface 33A. However, unlike the previous embodiments, wall portions 38A do extend to slit orifice 34A, but only in a form having a tapered transverse thickness "t" that decreases to an infinitesimally small edge 62 at the orifice. This is sufficient to minimize liquid flow vortices that would occur without the taper, thus producing a coalesced flow that exits orifice 34A. Stated in other words, the tapered edges 62 are so thin that the liquid "sees" the orifice as a continuous slit.

The distance "D" of the taper can be varied considerably. A useful example is about 1.0 mm (at least two times the spacing between wall portion 38A).

Figure 12:
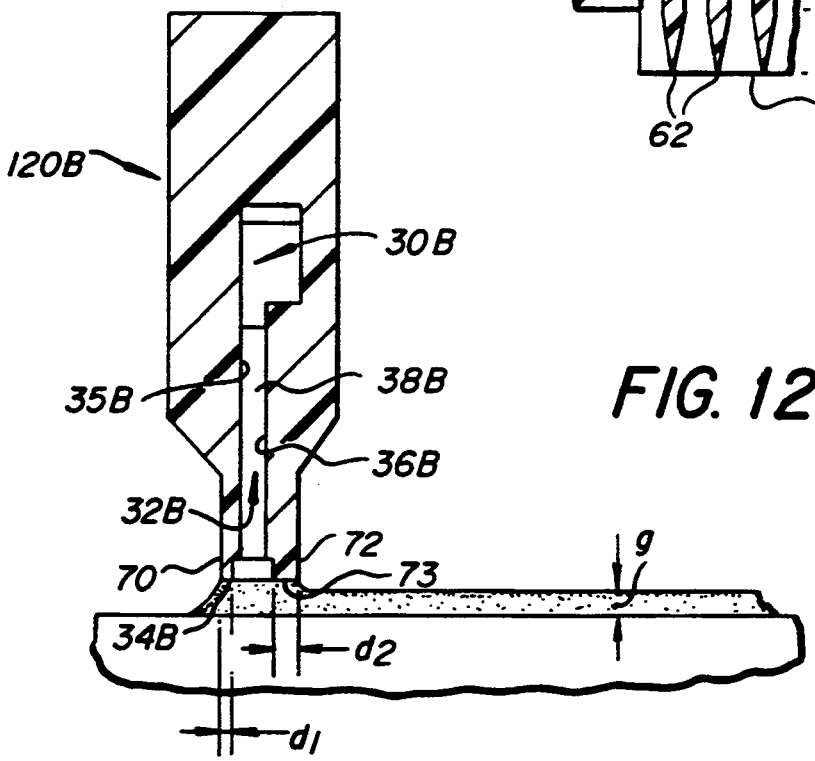
FIG. 12 is a section view similar to that of FIG. 7, but illustrating still another alternate embodiment.

As an optional additional feature, FIG. 12, means can be added to increase viscous resistance to flow of liquid from the slit orifice onto a surface, thereby further damping out vortices that may remain due to the presence of connecting wall portions at or adjacent to the slit orifice. Parts similar to those previously described bear the same reference numeral, to which the distinguishing suffix "B" is appended.

Thus, coater 120B comprises chamber 30B, delivery channel 32B, slit orifice 34B, and wall portions 38B connecting opposed flow surfaces 35B and 36B. Wall portions 38B stop short of orifice 34B, as in the embodiment of FIG. 7. However, the walls 70 and 72 defining slit orifice 34B are of substantially different thickness "d", and "$d_2$", FIG. 12. In particular, $d_2$ is made substantially larger than in other embodiments, to substantially increase the viscous resistance to flow between the face 73 and the receiving surface. There are two primary considerations in the choice of $d_2$: (1) The resistance should be great enough to assure that the liquid spans the entire space between face 73 and the receiving surface, at the prescribed fluid delivery rate and surface speed, (2) The distance $d_2$ should be large enough to viscously damp out eddies formed upstream at surface 70 and in channel 34B. That is, "$d_2$" is substantially greater in value than the gap "g". Most preferably, $d_2$ should be at least 5 times the spacing between surface 73 and the receiving surface to be effective; e.g., $d_2 \geqq 0.9$ mm for a flow gap "g" of 0.18 mm.

On the other hand, the thickness $d_1$ of wall 70 is not critical, but should be minimized to facilitate the formation of a continuous film of liquid on this upstream edge that bridges the distance between face 73 and the receiving surface. Most preferably, $d_1$ should be of the same order as the gap width g, e.g. $\approx 0.2$ mm.

Coater 120 can be manufactured from a variety of materials, but preferably from plastics resistant to the liquid being coated. For developer liquids, useful materials comprise polystyrene or polytetrafluoroethylene such as "Teflon" TM. Because these latter are non-wetting, a positive pressure should be applied at the inlet orifice until the hopper is completely filled, to minimize the possibility of air entrapment.

APPLICATION

The coater of this invention has been effective in repeatedly and intermittently applying a thin, low volume, uniform coating of developer liquid onto photographic products (e.g., via line 23, FIG. 7). The application rate has been no greater than that needed to swell the developable layers being coated, e.g., at a rate of between about 1 and 20 μL/cm of width/sec. The result is a substantially liquid effluent-free developing process.

Figure 13:
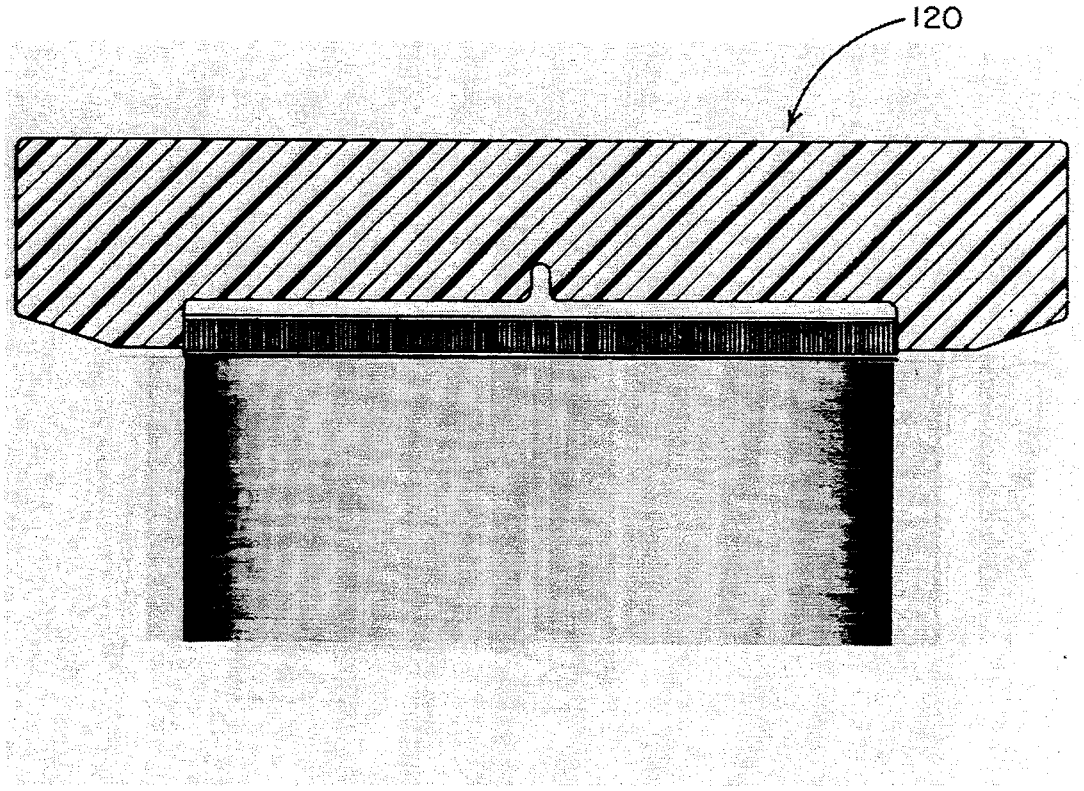
FIG. 13 is a schematic view similar to that of FIG. 4, but of a coater and the resulting print of the invention.

FIG. 13 illustrates the greater uniformity of flow and coating provided, using coater of FIG. 6. This is in marked contrast to the results of FIG. 4, a comparative example. (As in the case of FIG. 4, the developer concentration has been drastically reduced, by about 50%, to allow flow discrepancies to be distinguishable.) The spacing apart of wall portions 38 in the transversed direction in this coater was approximately 0.4 mm. A color print (not shown) was developed using the embodiment of FIG. 13 and a spacing "A" of about 0.4 mm, as follows, using Eastman Kodak Company's conventional CD3 and carbonate formulation applied to the paper separately:

34 μl/sec of potassium carbonate (112 g/L) in water from a 4 inch hopper to paper moving at 1 inch/sec., i.e., at an application rate of about 1.25 mL/ft.$^2$ (swell=2.5 ml/ft.$^2$). After allowing the activator to soak in for 20 secs, the above application was repeated using Kodak developer, CD3 (37.5 g/L) in water. Development was complete in 50 seconds at 21° C., and there was no effluent. The processed coating was put through a conventional bleach-fix treatment, washed and dried. The maximum density readings for this print were: cyan=1.32, magenta=1.35 and yellow=0.93. The print so developed showed the excellent uniformity in developer coating of this invention, while still producing substantially no liquid effluent.

The invention has been described in detail with particular reference to certain preferred embodiments thereof, but it will be understood that variations and modifications can be effected within the spirit and scope of the invention.

What is claimed is:

1. In a photographic developer apparatus for developing a photographic product, said developer apparatus comprising a source of developer liquid and a coater for delivery of the liquid in a uniform layer onto a surface of the photographic product, said coater comprising a body having an internal manifold chamber of a width generally equal to the width of a photographic product, means for introducing the liquid at a point within said chamber, a slit orifice shaded to deliver a uniform layer of liquid, and a delivery channel having a length extending from said manifold to said orifice, the improvement wherein said coater delivery channel comprises spaced-apart opposed surfaces connected together for the majority of said delivery channel length at spaced intervals by a plurality of wall portions in said channel extending between said surfaces in a first direction toward said orifice to confine liquid flow into spaced-apart individual streams of flow between said wall portions, and coalescing means disposed inside said orifice next to said wall portions for coalescing said individual streams together into a substantially continuous strip of liquid while still inside said orifice, so that said developer is effluent-free, and wherein said wall portions extend substantially completely across the gap between said surfaces and to said orifice with a thickness that tapers sufficiently as the orifice is reached as to aid coalescence of said separate streams at said orifice.

2. In a photographic developer apparatus for developing a photographic product, said developer apparatus comprising a source of developer liquid and a coater for delivery of the liquid in a uniform layer onto a surface of the photographic product, said coater comprising a body having an internal manifold chamber of a width generally equal to the width of a photographic product, means for introducing the liquid at a point within said chamber, a slit orifice shaded to deliver a uniform layer of liquid, and a delivery channel having a length extending from said manifold to said orifice, the improvement wherein said coater delivery channel comprises spaced-apart opposed surfaces connected together for the majority of said delivery channel length at spaced intervals by a plurality of wall portions in said channel extending between said surfaces in a first direction toward said orifice of confine liquid flow into spaced-apart individual streams of flow between said wall portions, and coalescing means disposed inside said orifice next to said wall portions for coalescing said individual streams together into a substantially continuous strip of liquid while still inside said orifice, so that said developer is effluent-free, and wherein said wall portions extending between said surfaces have a transverse thickness that decreases as said wall portions approach said orifice so as to minimize liquid flow vortices that can be created by said wall portions.

3. A developer apparatus as defined in claim 1 or 2, wherein said coalescing means are defined by the termination of said wall portions just inside said orifice to define a pocket within said orifice and extending generally perpendicular to said first direction, that is free of said wall portions so as to provide said coalescing of said streams.

4. A developer apparatus as defined in claim 2, wherein said spaced-apart surfaces are spaced further apart at said orifice than at a location just inside said orifice to provide at least one edge surface for pinning a meniscus within said orifice when flow has temporarily been terminated.

5. A developer apparatus as defined in claim 1 or 2, wherein said wall portions confining said liquid into said streams are spaced away from and do not extend to the junction of said delivery channel and said manifold, so that a continuous flow chamber is provided at said junction sufficient to allow maximum air displacement when liquid enters said manifold chamber from said introducing means.

6. A developer apparatus as defined in claim 1 or 2, and further including at said orifice, resistance means for increasing viscous resistance to flow of liquid outside of said orifice and onto the surface being coated.

7. A developer apparatus as defined in claim 6, wherein said resistance means comprise an edge of said coater at said orifice that is substantially greater in thickness in the direction of flow of liquid from said orifice onto the surface than the spacing of said coater orifice from the surface being coated.

* * * * *

UNITED STATES PATENT AND TRADEMARK OFFICE

CERTIFICATE OF CORRECTION

PATENT NO. : 5,334,247
DATED : August 2, 1994
INVENTOR(S) : Ricard L. Columbus and Harvey J. Palmer It is certified that error appears in the above-indentified patent and that said Letters Patent is hereby corrected as shown below:

Column 8, line 25, "shaded" should read --shaped--
and line 64, "of confine" should read --to confine--.

Signed and Sealed this

Twentieth Day of December, 1994

*Attest:*

Bruce Lehman

BRUCE LEHMAN

*Attesting Officer*

*Commissioner of Patents and Trademarks*